US008146609B2

(12) United States Patent
Gibis et al.

(10) Patent No.: US 8,146,609 B2
(45) Date of Patent: Apr. 3, 2012

(54) DEVICE STATUS INDICATOR FOR A MULTI-DOSING DETERGENT DELIVERY DEVICE

(75) Inventors: Karl-Ludwig Gibis, Limburgerhof (DE); Chris Efstathios Housmekerides, Wassenaar (NL)

(73) Assignee: Reckitt Benckiser N.V., WT Hoofddorp (NL)

( * ) Notice: Subject to any disclaimer, the term of this patent is extended or adjusted under 35 U.S.C. 154(b) by 286 days.

(21) Appl. No.: 12/447,058

(22) PCT Filed: Oct. 29, 2007

(86) PCT No.: PCT/GB2007/004115
§ 371 (c)(1),
(2), (4) Date: Nov. 4, 2009

(87) PCT Pub. No.: WO2008/053183

PCT Pub. Date: May 8, 2008

(65) Prior Publication Data

US 2010/0071733 A1 Mar. 25, 2010

(30) Foreign Application Priority Data

Oct. 30, 2006 (GB) ..... 0621576.8

(51) Int. Cl.
*B08B 3/02* (2006.01)

(52) U.S. Cl. ..... 134/93; 68/17 R

(58) Field of Classification Search ..... 68/12.18, 68/17 R, 207; 134/113, 93
See application file for complete search history.

(56) References Cited

U.S. PATENT DOCUMENTS 2,370,609 A 2/1945 Wilson
2,514,000 A 7/1950 Kent
2,777,570 A 1/1957 Mytinger
2,880,077 A 3/1959 Floria
2,954,145 A 9/1960 McCauley
3,063,459 A 11/1962 Jacobs
3,091,402 A 5/1963 Palmer (Continued)

FOREIGN PATENT DOCUMENTS

CA 2313356 A1 1/2001

(Continued)

OTHER PUBLICATIONS

WIPO WO 2006/000237 Jan. 2006.

(Continued)

*Primary Examiner* — Frankie L Stinson
(74) *Attorney, Agent, or Firm* — Norris McLaughlin & Marcus PA

(57) ABSTRACT

The present invention concerns a multi-dosing detergent delivery device including a status indicator for providing an external indication of the internal status of the device. The indicator comprises a first element (140) internal to a main housing part (100) of the device and whose position is directly related to the status of the device and a second element (120) external of the main housing. The second element (120) and the first element (140) are linked together by means of magnetic attraction. In a preferred embodiment of the invention, the first element (140) comprises a magnet and the second element (120) comprises a ferro-magnetic sphere, held within a transparent dome (110). The sphere (120) and dome (110) are mounted to the exterior of a main housing of the device and form an isolated sub-housing, while the magnet (140) is provided internally. Motion of the magnet (140) is translated to motion of the sphere (120) and a static scale adjacent to the path of movement of the sphere indicates the device status.

9 Claims, 2 Drawing Sheets

U.S. PATENT DOCUMENTS

| | | | | |
|---|---|---|---|---|
| 3,187,767 | A | 6/1965 | Sheppard | |
| 3,198,010 | A | 8/1965 | Huston | 73/313 |
| 3,272,899 | A | 9/1966 | Diamond et al. | |
| 3,411,671 | A | 11/1968 | Harvey et al. | |
| 3,482,740 | A | 12/1969 | Evans et al. | |
| 3,494,436 | A | 2/1970 | Lanning | 177/144 |
| 3,688,795 | A | 9/1972 | Taylor | 137/558 |
| 3,759,284 | A | 9/1973 | Crowley et al. | |
| 3,822,561 | A | 7/1974 | Miller | |
| 4,055,278 | A | 10/1977 | Seymour | |
| D269,801 | S | 7/1983 | Sangster et al. | |
| 4,416,859 | A | 11/1983 | Brown et al. | |
| D273,033 | S | 3/1984 | Sangster et al. | |
| D280,757 | S | 9/1985 | Paulovich et al. | |
| 4,700,554 | A | 10/1987 | Eichman et al. | |
| 4,835,804 | A | 6/1989 | Arnau-Munoz et al. | |
| D304,102 | S | 10/1989 | Lakhan et al. | |
| 4,917,272 | A | 4/1990 | Ikeda | |
| D308,739 | S | 6/1990 | Nystuen | |
| 4,999,124 | A | 3/1991 | Copeland | |
| 5,033,643 | A | 7/1991 | Schumacher | |
| 5,088,517 | A | 2/1992 | Bersch | 137/101.11 |
| D328,332 | S | 7/1992 | Fink | |
| D328,333 | S | 7/1992 | Casberg | |
| 5,137,694 | A | 8/1992 | Copeland | |
| D346,890 | S | 5/1994 | Panesar | |
| 5,310,430 | A | 5/1994 | McCall, Jr. | |
| 5,474,211 | A | 12/1995 | Hellenberg | |
| 5,500,050 | A | 3/1996 | Chan et al. | |
| D376,320 | S | 12/1996 | Lathrop et al. | |
| 5,603,233 | A | 2/1997 | Erickson et al. | |
| D381,141 | S | 7/1997 | Balz | |
| D383,264 | S | 9/1997 | Balz | |
| 5,679,173 | A | 10/1997 | Hartman | |
| 5,681,400 | A | 10/1997 | Brady et al. | |
| 5,870,906 | A | 2/1999 | Denisar | |
| 5,967,158 | A | 10/1999 | Smith et al. | |
| 5,971,154 | A | 10/1999 | Toren | |
| 6,048,501 | A | 4/2000 | Lemaire et al. | |
| 6,058,946 | A | 5/2000 | Bellati et al. | |
| 6,173,743 | B1 | 1/2001 | Ibanez Sapina | |
| 6,178,987 | B1 | 1/2001 | Caruthers, Jr. et al. | |
| 6,263,708 | B1 | 7/2001 | Yarmosky | |
| 6,375,038 | B1 | 4/2002 | Daansen et al. | |
| D457,596 | S | 5/2002 | Guzman et al. | |
| 6,463,766 | B2 | 10/2002 | Kubota et al. | |
| D465,258 | S | 11/2002 | Hiranaga et al. | |
| 6,571,993 | B2 | 6/2003 | Rodd et al. | |
| 6,581,800 | B2 | 6/2003 | Rodd et al. | |
| 6,608,022 | B1 | 8/2003 | Zabarylo et al. | |
| D481,844 | S | 11/2003 | Greene et al. | |
| 6,681,963 | B2 | 1/2004 | Hague et al. | |
| D513,928 | S | 1/2006 | Birdsell et al. | |
| D526,043 | S | 8/2006 | Thompson | |
| D529,128 | S | 9/2006 | Lee | |
| 7,188,521 | B2 | 3/2007 | Fling et al. | 73/320 |
| D539,993 | S | 4/2007 | Brandt | |
| 7,219,518 | B2 | 5/2007 | Aouad et al. | |
| D547,912 | S | 7/2007 | Brandt | |
| 7,276,470 | B2 | 10/2007 | Hahn | |
| D564,141 | S | 3/2008 | Gaa et al. | |
| D564,142 | S | 3/2008 | Gaa et al. | |
| D564,143 | S | 3/2008 | Gaa et al. | |
| D568,555 | S | 5/2008 | Gaa et al. | |
| 7,421,867 | B2 | 9/2008 | Bongini | |
| 7,428,831 | B2 | 9/2008 | Cho et al. | |
| D601,766 | S | 10/2009 | Gaa et al. | |
| D604,466 | S | 11/2009 | Gaa et al. | |
| D608,960 | S | 1/2010 | Gaa et al. | |
| 7,913,639 | B2 | 3/2011 | Canavoi et al. | 116/201 |
| 2001/0010165 | A1 | 8/2001 | Kubota et al. | |
| 2002/0169092 | A1 | 11/2002 | Alexandre Catlin et al. | |
| 2003/0052138 | A1 | 3/2003 | Smith | |
| 2003/0168085 | A1 | 9/2003 | Sowle et al. | |
| 2003/0182732 | A1 | 10/2003 | Davenet et al. | |
| 2004/0103925 | A1 | 6/2004 | Marettek | |
| 2004/0206133 | A1 | 10/2004 | Woo et al. | |
| 2004/0216499 | A1 | 11/2004 | Bongini | |
| 2004/0217125 | A1 | 11/2004 | Marone | 222/64 |
| 2005/0023290 | A1 | 2/2005 | Kon et al. | |
| 2005/0039781 | A1 | 2/2005 | Song et al. | |
| 2005/0121058 | A1 | 6/2005 | Furber et al. | |
| 2005/0139241 | A1 | 6/2005 | Jowett et al. | |
| 2005/0148497 | A1 | 7/2005 | Khan | |
| 2005/0235704 | A1 | 10/2005 | Cho et al. | |
| 2007/0000068 | A1 | 1/2007 | Gerard France et al. | |
| 2007/0295036 | A1 | 12/2007 | Brandt et al. | |
| 2008/0053187 | A1 | 3/2008 | Koring | |
| 2008/0053494 | A1 | 3/2008 | Moro et al. | |

FOREIGN PATENT DOCUMENTS

| | | | |
|---|---|---|---|
| DE | 2244722 | | 10/1973 |
| DE | 3513640 | A1 | 10/1986 |
| DE | 8814550 | U1 | 1/1989 |
| DE | 4400417 | A1 | 7/1995 |
| DE | 19516312 | C1 | 8/1996 |
| DE | 19540608 | A1 | 5/1997 |
| DE | 19652733 | A1 | 6/1998 |
| DE | 19740819 | A1 | 3/1999 |
| DE | 19836857 | A1 | 2/2000 |
| DE | 19930771 | A1 | 1/2001 |
| EP | 0457137 | A1 | 11/1991 |
| EP | 0481547 | A1 | 4/1992 |
| EP | 0521179 | A1 | 1/1993 |
| EP | 0906747 | A2 | 4/1999 |
| FR | 2723751 | A1 | 2/1996 |
| FR | 2723752 | A1 | 2/1996 |
| GB | 820327 | | 9/1959 |
| GB | 1142238 | | 2/1969 |
| GB | 1198251 | | 7/1970 |
| GB | 2037719 | A | 7/1980 |
| GB | 1592357 | | 7/1981 |
| GB | 2104109 | A | 3/1983 |
| GB | 2134654 | A | 8/1984 |
| GB | 2244722 | A | 12/1991 |
| GB | 2339678 | A | 2/2000 |
| GB | 2356842 | A | 6/2001 |
| GB | 2386129 | A | 9/2003 |
| GB | 2386130 | A | 9/2003 |
| GB | 242679 | A | 12/2004 |
| GB | 2402604 | A | 12/2004 |
| GB | 2406821 | A | 4/2005 |
| GB | 2417492 | A | 3/2006 |
| JP | 01-317493 | | 12/1989 |
| JP | 2000317350 | A | 11/2000 |
| JP | 2003260130 | A | 9/2003 |
| JP | 2006061450 | | 3/2006 |
| JP | 2006122196 | A | 5/2006 |
| KR | 950002460 | B1 | 3/1995 |
| SU | 838371 | | 6/1981 |
| WO | 8806199 | A1 | 8/1988 |
| WO | 9712539 | A1 | 4/1997 |
| WO | 0107702 | A1 | 2/2001 |
| WO | 0107703 | A1 | 2/2001 |
| WO | 0178572 | A2 | 10/2001 |
| WO | 0220893 | A | 3/2002 |
| WO | 02058528 | A1 | 8/2002 |
| WO | 02076278 | A2 | 10/2002 |
| WO | 03073907 | A2 | 3/2003 |
| WO | 03073906 | A1 | 9/2003 |
| WO | 2004033297 | A2 | 4/2004 |
| WO | 2004041248 | A2 | 5/2004 |
| WO | 2004044303 | A1 | 5/2004 |
| WO | 2004059068 | A1 | 7/2004 |
| WO | 2004085595 | A1 | 10/2004 |
| WO | 2005099552 | A | 10/2005 |
| WO | 2006021760 | A | 3/2006 |
| WO | 2006021761 | A1 | 3/2006 |
| WO | 2006021773 | A1 | 3/2006 |
| WO | 2007051989 | A1 | 5/2007 |
| WO | 2007083142 | A1 | 7/2007 |

OTHER PUBLICATIONS

English Language Translation for DE3513640 taken from esp@cenet.com.

English Language Translation for KR950002460 taken from esp@cenet.com.

English Language Translation for DE8814550U taken from esp@cenet.com.
International Search Report PCT/GB2005/003271.
Written Opinion PCT/GB2005/003271.
Written Opinion PCT/GB2005/003265.
International Search Report PCT/GB2005/003265.
English Translation of application FR 2723751 taken from esp@net.com.
English Translation application DE 19740819 A1 taken from esp@net.com.
English Translation application DE 19516312 C1 taken from esp@net.com.
English Translation of EP 0906747 provided by esp@cenet.
English Abstract of JP 2000-317350 taken from espa@cenet.
English Abstract of JP 2003-260130 taken from espa@cenet.
English Abstract of JP 2006-122196 taken from espa@cenet.
English Abstract of KR 2002001154 cited by examiner in Office Action dated Oct. 26, 2011 of related U.S. Appl. No. 12/447,509.
English Translation application DE 4400417 taken from esp@cenet.com.

DEVICE STATUS INDICATOR FOR A MULTI-DOSING DETERGENT DELIVERY DEVICE

This is an application filed under 35 USC 371 of PCT/GB2007/004115.

The invention relates to a device status indicator for a multi-dosing detergent delivery device.

For many devices, it is desirable to display an external indication denoting the internal state of a device. For a multi-dosing detergent delivery device, it is necessary to provide an external indication showing either how many doses of detergent have already been delivered, or how many doses are remaining within the device.

Conventionally, in simple mechanical devices where it is desired to avoid any electrical or electronic components, a numbered or coloured dial might be used so as to provide a status indication or similar. However, in certain harsh environments, such as dishwashers, it is also desirable to provide as much isolation between internal working parts of a device, and external housing components. Here, it may be imagined that in certain environments it is desirable to provide complete isolation of internal components. Also, an external casing and housing may need to be robust so as to avoid the penetration of the housing from fluids, contaminants or other items.

In addition, whenever there is a direct mechanical linkage between internal and external components of a device the linkage itself it susceptible to mechanical wear of may in itself simply cause a device weakness.

GB 1,096,550 (INVENTIO AKTIENGESSELSCHAFT) discloses a rotation indicator for indicating the movement of a rotary body enclosed in a sealed housing without having an aperture through the housing, wherein a magnet on the rotary body has poles disposed asymmetrically with respect to the axis of rotation of the rotary body, a circular path being provided outside the housing and an indicator member of magnetisable material being provided in the form of a roller member having an indicator marking and a circular rolling track surface of a different maximum diameter from that of the circumference of the circular rolling path and which is rolled on the circular rolling path by the attraction of the magnet on rotation of the rotary body.

It is an aim of the embodiments of the invention to provide an external lifetime or status indicator providing an external indication of an internal state of a multi-dosing detergent delivery device wherein the structural integrity of the device housing is not impaired by the indication mechanism.

According to a first aspect of the invention, there is provided a multi-dosing detergent delivery device including a status indicator for providing an external indication of the internal status of a device, wherein said indicator comprises: a first element internal to a main housing part of said device and whose position is directly related to the status of said device; and a second element external of said main housing, wherein said second element and said first element are linked together by means of magnetic attraction.

Preferably, wherein said second element is provided within a transparent sub-housing to facilitate a user viewing the position of said second element.

Preferably a static indicator scale is provided aligned with a path of movement of the second element.

Said indicator may be numbered and/or coloured or otherwise marked so as to correspond with the status of the device.

Said first element is preferably mounted onto a shaft of the device and the rotational position of the shaft corresponds directly to the device status.

Preferably the status indicator of the device indicates a wash number of the multi-dosing detergent delivery device so as to indicate a number of washes undertaken or remaining and hence a number of detergent doses dispensed or remaining to be dispensed by the device. Preferably, said shaft forms part of a detergent dispensing mechanism.

Preferably said shaft corresponds to the shaft of a refill holder, and the position of said shaft indicates how many dosage elements of the multi-dosing system remain or have been used.

Preferably said first element comprises a magnet and said second element comprises a sphere of ferro-magnetic material.

For a better understanding of the invention, a preferred embodiment will now be described, by way of example only, in which.

Figure 1:
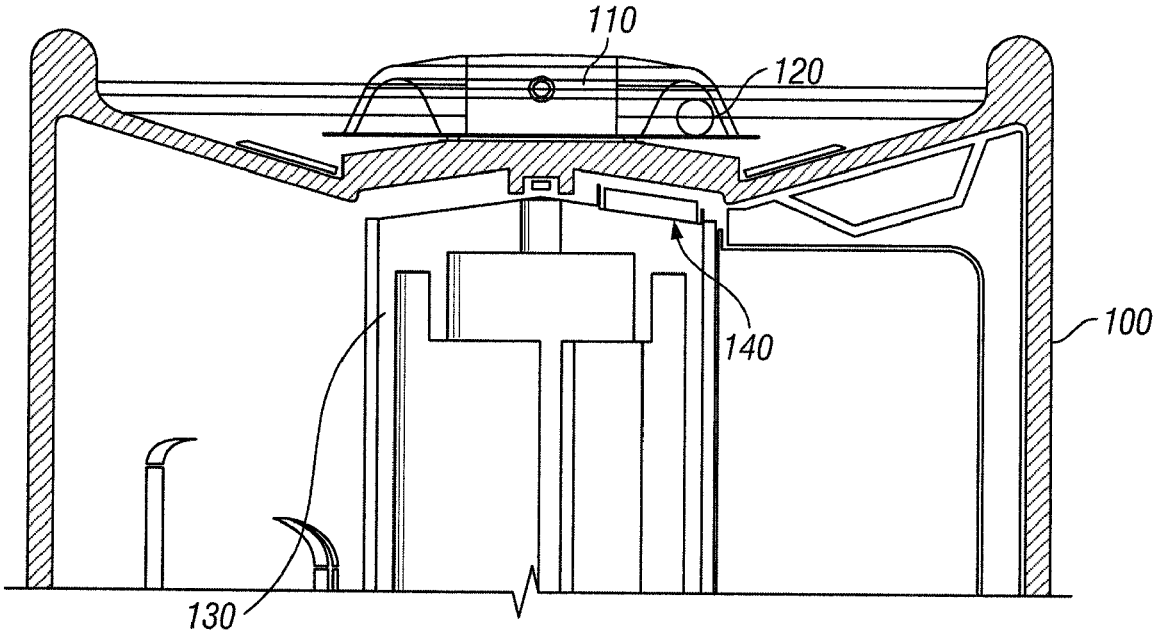
FIG. 1 is a cross sectional view showing part of a device including a status indicator according to an embodiment of the invention.

Reviewing now to FIG. 1 there is shown a device lid portion 100, having a transparent dome 110, within a peripheral region of which is trapped a metallic sphere 120. The transparent dome 110 and sphere 120, are formed to the exterior of the device 100, whilst on the interior of the device there is provided a mechanically rotating element 130, to which there is fixed a magnet 140.

Figure 2:
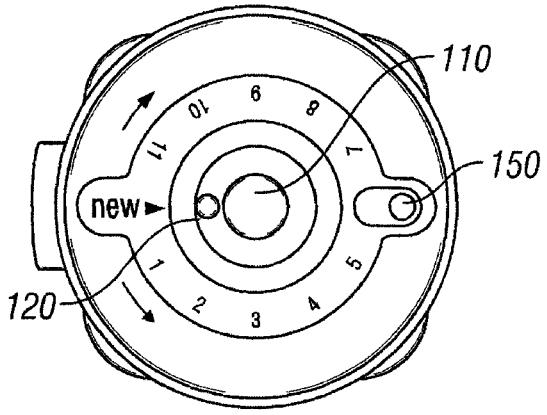
FIG. 2 is an external view showing the indicator and device of the first embodiment.
Figure 3:
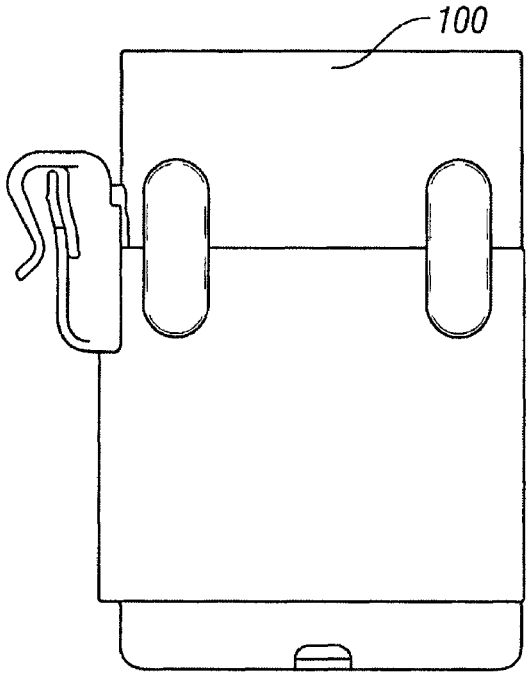
FIG. 3 is a side elevation of a device incorporating the indicator.

Whilst the particulars of the device itself are not important to the understanding of the present invention, it should be noted that the device of FIGS. 1 to 3 is a multi-dosing detergent delivery device, which is susceptible of delivering a discrete dose of detergent into a dishwashing machine during a single washing cycle, and then automatically advances to a next dosage position for the carrying out of a subsequent dishwashing cycle and that the status indicator forms an indicator showing a number of washes undertaken or remaining and hence a number of detergent doses dispensed or remaining to be dispensed by the device. In this connection, the lid 100 of the device also includes, as shown in FIG. 2, an aperture 150 to allow water/wash liquor to enter into an internal region of the device. Further, the lid 100 is generally funnel shaped so as to enable water to be collected by the top of the lid portion 100 and directed towards the aperture 150. Also, as will be apparent from FIG. 2 the lid is provided with indicators such as "new" and "1", "2", . . . "11", which provide a static dial indicative of a usage status/wash number of the device.

A brief summary of the workings of the device shown in FIGS. 1 to 3 now follows. However, it should be noted that the scope of the present invention may not be limited exclusively to use with such a device.

The device of FIGS. 1 to 3 is generally cylindrical and is arranged to receive a cartridge of 12 dosage elements (not shown). Each dosage element includes sufficient cleaning composition for one dishwashing cycle. The dosage elements are enclosed within individual plastic sleeves, or blisters, having upper and lower holes. In use, one dosage element per dishwashing cycle receives water from the lid area 100 of the device through aperture 150, being in registration with the upper hole of the chamber. Water flows into the chamber and dissolves the cleaning composition which washes out through the lower hole of the chamber and into the washing machine. The device includes a thermally reactive element which, during a cooling phase of the dishwasher ensures automatic advance of the refill cartridge so that a neighbouring cartridge then has it's upper opening in registration with the aperture 150.

The refill cartridge is carried by a refill holder, which during said movement phase, rotates by an amount equivalent to the spacing between chambers. Here, the rotation is 30° (one twelfth of 360°—as there are 12 chambers per refill). The refill holder, has, at a top portion thereof, a mechanically fixed magnet 140. This magnet 140 will, as the refill holder rotates, also rotate. Because the sphere 120 held beneath transparent dome 110 is of a ferro-magnetic material, the sphere is attracted to the position of the magnet 140. Thereby, each time the refill holder 130 rotates, the magnet 140 rotates, and the sphere 120 will adopt a new position over the magnet 140. By providing an external static scale on the lid 100, a status indication is very conveniently given to the user, to indicate how many washing cycles remain, before the device needs to be replenished with a new refill.

As long as the magnet may be affixed to a position adjacent to a housing wall, and, within the limitations of the thickness of the housing wall and the strength of magnet, an easy visual location may be provided to a user as to the device status itself.

It will be appreciated that the device described above provides a magnetic wash number indicator of a multi-dosing detergent delivery device which is extremely advantageous and susceptible of providing reliable operation within the harsh environments found within a dishwasher.

By providing indication via magnetic attraction, it will be appreciated that the status of the device may be displayed, even when the internal parts of the device are completely sealed, in a watertight, gastight manner, from the external environment. In other words, by providing such an indication as described herein, an extremely robust device may be provided. By the elimination also of mechanical indicating devices, fewer moving parts are required and there is a higher resistance to failure.

The invention claimed is:

1. A multi-dosing detergent delivery device comprising a status indicator for providing an external indication of the internal status of the device, wherein said status indicator indicates a wash number of the multi-dosing detergent delivery device and which comprises;

a first element internal to a main housing part of said device and whose position is directly related to the status of said device and a second element external of said main housing, wherein:

said second element and said first element are linked together by means of magnetic attraction;

wherein said first element is mounted onto a shaft of the device and the status indicator, said shaft corresponds to a refill holder which forms part of a detergent dispensing mechanism, where the rotational position of the shaft corresponds to the internal status of the device and, the position of the shaft corresponds to how many dosage elements of the multi-dosing detergent delivery device remain or have been used.

2. A device according to claim 1, wherein said second element is provided within a transparent sub-housing adapted to facilitate a user viewing the position of said second element.

3. A device according to claim 2, wherein a static indicator scale is provided aligned with a path of movement of the second element.

4. A device according to claim 2, wherein said first element is mounted onto a shaft of the device and the rotational position of the shaft corresponds directly to the device status.

5. A device according to claim 1, wherein a static indicator scale is provided aligned with a path of movement of the second element.

6. A device according to claim 5, wherein said indicator is numbered or coloured or otherwise marked so as to correspond with the status of the device.

7. A device according to claim 5, wherein said first element is mounted onto a shaft of the device and the rotational position of the shaft corresponds directly to the device status.

8. A device according to claim 1, wherein said first element comprises a magnet and said second element comprises a ferro-magnetic material.

9. A device according to claim 8, wherein said second element is a sphere.

* * * * *